US009228521B2

(12) United States Patent
Imai

(10) Patent No.: US 9,228,521 B2
(45) Date of Patent: Jan. 5, 2016

(54) FUEL INJECTION CONTROLLER AND FUEL-INJECTION-CONTROL SYSTEM

(71) Applicant: DENSO CORPORATION, Kariya, Aichi-pref. (JP)

(72) Inventor: Keita Imai, Kariya (JP)

(73) Assignee: DENSO CORPORATION, Kariya (JP)

( * ) Notice: Subject to any disclaimer, the term of this patent is extended or adjusted under 35 U.S.C. 154(b) by 143 days.

(21) Appl. No.: 14/070,670

(22) Filed: Nov. 4, 2013

(65) Prior Publication Data

US 2014/0124601 A1 May 8, 2014

(30) Foreign Application Priority Data

Nov. 5, 2012 (JP) ..... 2012-243624

(51) Int. Cl.
*F02D 41/20* (2006.01)

(52) U.S. Cl.
CPC ..... *F02D 41/20* (2013.01); *F02D 2041/2017* (2013.01); *F02D 2041/2041* (2013.01); *F02D 2041/2044* (2013.01); *F02D 2041/2058* (2013.01); *F02D 2041/2065* (2013.01)

(58) Field of Classification Search
CPC ..... F02D 41/20; F02D 2041/2003; F02D 2041/2013; F02D 2041/202; F02D 2041/2024; F02D 2041/2034; F02D 2041/2048; F02D 2041/51; F02D 2041/2058; F02M 51/061
See application file for complete search history.

(56) References Cited

U.S. PATENT DOCUMENTS

| | | | | |
|---|---|---|---|---|
| 5,992,391 | A * | 11/1999 | Yamakado et al. | 123/490 |
| 6,571,773 | B1 * | 6/2003 | Yamakado et al. | 123/490 |
| 6,981,663 | B2 | 1/2006 | Fukutomi | |
| 2011/0222202 | A1 * | 9/2011 | Onda et al. | 361/152 |
| 2012/0180762 | A1 * | 7/2012 | Casasso | 123/472 |
| 2012/0216783 | A1 | 8/2012 | Kusakabe et al. | |

FOREIGN PATENT DOCUMENTS

| | | |
|---|---|---|
| JP | 4-287850 | 10/1992 |
| JP | 2005-330934 | 12/2005 |
| JP | 2009-024662 | 2/2009 |
| JP | 2012-167561 | 9/2012 |

OTHER PUBLICATIONS

Office Action (2 pages) dated Dec. 2, 2014, issued in corresponding Japanese Application No. 2012-243624 and English translation (2 pages).

(Continued)

*Primary Examiner* — Ryan Reis
(74) *Attorney, Agent, or Firm* — Nixon & Vanderhye PC

(57) ABSTRACT

A fuel injection controller includes a current-increase control portion applying a voltage to the coil so that the coil current is increased to a first target value, and a current-hold control portion applying the voltage to the coil so that the increased coil current is held at the first target value. A maximum electromagnetic attracting force to start a valve opening is referred to as a required valve-opening force. A saturated electromagnetic attracting force by the coil current of the first target value is referred to as a static attracting force. The first target value is established in such a manner that the static attracting force is greater than the required valve opening force.

3 Claims, 5 Drawing Sheets

(56) References Cited

OTHER PUBLICATIONS

Imai et al., U.S. Appl. No. 14/071,200, filed Nov. 4, 2013.
Imai, U.S. Appl. No. 14/071,228, filed Nov. 4, 2013.
Office Action (2 pages) dated Jul. 7, 2015, issued in corresponding Japanese Application No. 2012-243624 and English translation (2 pages).
Office Action (10 pgs.) dated May 18, 2015 issued in co-pending U.S. Appl. No. 14/071,228.

* cited by examiner

FUEL INJECTION CONTROLLER AND FUEL-INJECTION-CONTROL SYSTEM

CROSS-REFERENCE TO RELATED APPLICATION

This application is based on Japanese Patent Application No. 2012-243624 filed on Nov. 5, 2012, the disclosure of which is incorporated herein by reference.

TECHNICAL FIELD

The present disclosure relates to a fuel injection controller and a fuel injection system which control a fuel injection start time and a fuel injection quantity by controlling an energization of a fuel injector.

BACKGROUND

JP-2012-177303A shows a fuel injection controller which controls a fuel injector. The fuel injector has a coil. When the coil is energized, the coil generates an electromagnetic force which lifts up a valve body to inject a fuel. The fuel injection controller controls an energization start time of the coil and an energization period, whereby a fuel injection start time and a fuel injection quantity are controlled.

In the fuel injection controller, as shown in FIG. 7B, after an energization of the coil is started, a voltage-application is continued until the coil current reaches a target peak value Ipeak. The target peak value Ipeak is required to lift up the valve body to the maximum lift position.

The electric current required to hold the valve body at the maximum lift position is less that the target peak value Ipeak. Because, when the electromagnetic force is increased, a magnetic field change is large and a inductance is also large. Meanwhile, when the electromagnetic attracting force is kept at a constant value, the inductance is small.

In the above conventional controller, when the coil current reaches the target peak value, the coil current is decreased and is kept at a hold value (hold which is smaller than the target peak value Ipeak.

When a temperature of a coil is increased, an electric resistance of the coil is also increased. As shown by dashed lines in FIGS. 7A and 7B, a time period t10-t20 in which the coil current reaches the target peak value Ipeak becomes longer. As a result, since an increasing ratio ΔF of attracting force becomes smaller (dashed line in FIG. 7C), a valve opening start time "ta" is delayed and a valve opening period Tact becomes shorter.

According to a temperature characteristic of the coil current, an increasing ratio ΔI of the electric current is varied. As the result, the increasing ratio ΔF of attracting force is varied, so that the valve opening start timing "ta" and the valve opening period Tact are varied. That is, since the valve opening start timing "ta" and the valve opening period Tact receive an influence of the temperature characteristic, a fuel injection accuracy relative to the energization start time t10 and the energization period Ti is deteriorated.

Especially, in a case that a multi-stage injection is conducted in one combustion cycle, it is required that small amount fuel is injected with high accuracy. In such a small injection, a deviation of the injection start time "ta" becomes large, so that the injection accuracy due to the temperature characteristic is further deteriorated.

SUMMARY

It is an object of the present disclosure to provide a fuel injection controller and a fuel injection system in which a robustness is improved relative to a temperature characteristic.

A fuel injection controller is applied to a fuel injector which opens a valve body by electromagnetic attracting force generated by applying a coil current to a coil.

The controller includes a current-increase control portion applying a voltage to the coil so that the coil current is increased to a first target value; and a current-hold control portion applying the voltage to the coil so that the increased coil current is held at the first target value.

A maximum electromagnetic attracting force to start a valve opening is referred to as a required valve-opening force, and a saturated electromagnetic attracting force by the coil current of the first target value is referred to as a static attracting force. The first target value is established in such a manner that the static attracting force is greater than or equal to the required valve opening force.

As shown in FIGS. 5A to 5D, in the current-increase period t10-t11 and the current-hold period t11-t13, the electromagnetic attracting force is increased to the static attracting force Fb. The rate of the current-increase period t10-t11 relative to the attractive force increase period t10-ta is made smaller.

As described above, the increasing ratio ΔI of the electric current is varied according to the temperature characteristic. Thus, the current-increase period t10-t11 receives the influence from the temperature characteristic. Meanwhile, since the coil current is held at the first target value in the current-hold period t11-t13, the increase rate ΔF of the attracting force hardly receive the influence of the temperature characteristic in the current-hold period t11-t13.

Meanwhile, according to the present disclosure, since the rate of the current-increase period t10-t11 relative to the attractive force increase period t10-ta can be made smaller, the increase rate ΔF of the attracting force hardly receive the influence of the temperature characteristic (dashed line in FIG. 5C). In the conventional controller shown in FIGS. 7A to 7D, when the coil current reaches the target peak value Ipeak, the hold-current is decreased. Thus, a current-increase period t10-t20 is equal to an attractive force increase period t10-t30. Thus, the increase rate ΔF of the attracting force receives the influence of the temperature characteristic (dashed line in FIG. 7C).

Therefore, according to the present disclosure, the increasing ratio ΔF of attracting force hardly receive the influence of the temperature characteristic. It is restricted that the valve opening time "ta" and the valve opening period Tact are varied according to the temperature characteristic (dashed line in FIG. 5D). Therefore, it is restricted that the injection accuracy is deteriorated relative to the energization start time t1 and the energization period Ti. The robustness of the control relative to the temperature characteristics can be improved.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereinafter, an embodiment of a fuel injection controller will be described with reference to the drawings.

Figure 1:
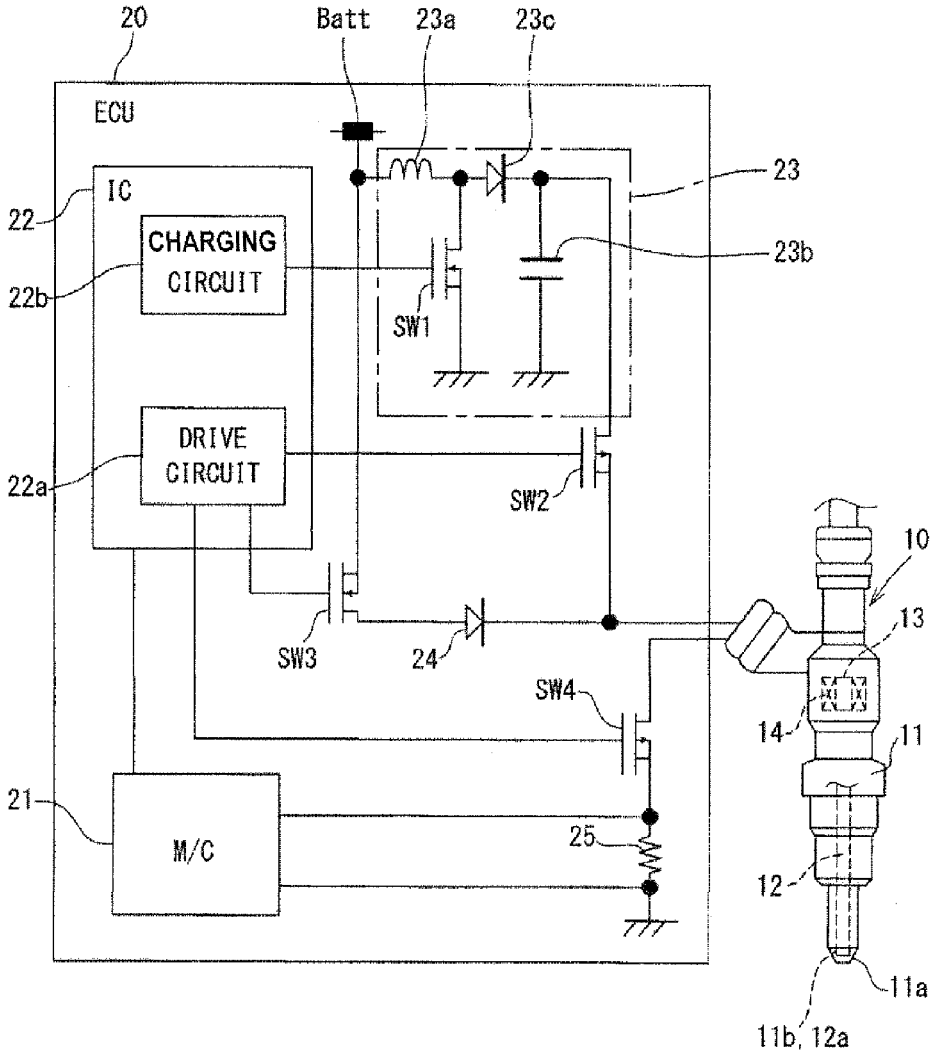
FIG. 1 is a schematic view showing a fuel injection controller according to an embodiment.

As shown in FIG. 1, a fuel injector 10 is provided to an internal combustion engine (gasoline engine), and injects a fuel directly to the combustion chamber. The fuel injector 10 has a body 11 which has a fuel passage and an injection port 11*a*. A valve body 12, a movable core (not shown), and a fixed core 13 are accommodated in the body 11. The valve body 12 has a valve seat surface 12*a* which contacts or separates a body seat surface 11*b* of the body 11. When the valve seat surface 12*a* contacts the body seat surface 11*b*, a fuel injection through the injection port 11*a* is terminated. When the valve seat surface 12*a* is lifted up from the body seat surface 11*b*, the fuel is injected through the injection port 11*a*.

The fixed core 13 has a coil 14. When the coil 14 is energized, the fixed core 13 generates a magnetic attraction force which attracts the movable core. The valve body 12 is also lifted up with the movable core. When the coil 14 is deenergized, the valve body 12 sits on the valve seat surface 12*a* by biasing force of a spring (not shown).

Figure 2:
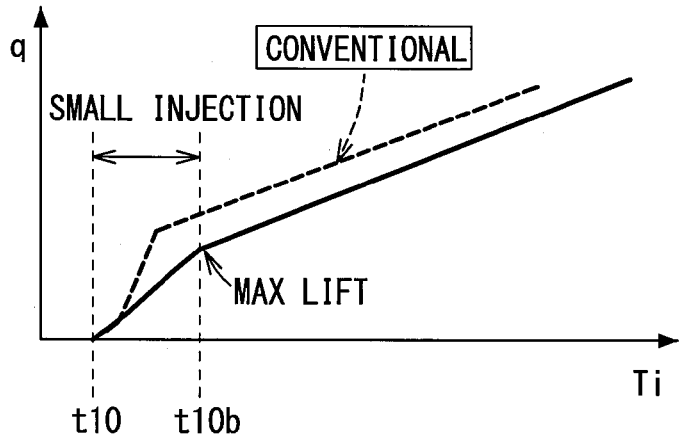
FIG. 2 is a chart showing a relationship between an energization period Ti and an injection quantity "q"

An electronic control unit (ECU) 20 includes a microcomputer 21, an integrated circuit (IC) 22, a booster circuit 23, and switching elements SW2, SW3, and SW4. The microcomputer 21 has a central processing unit, a nonvolatile memory (ROM), and a volatile memory (RAM). The microcomputer 21 computes a target injection quantity and a target injection start time of a fuel based on the engine load and the engine speed. FIG. 2 shows an injection characteristic. An injection quantity "q" is controlled according to an energization period "Ti" of the coil 14. In FIG. 2, "t10" represents an energization start time. "t10b" represents a time in which an opening degree of the injection port 11*a* becomes maximum. The moving core is brought into contact with the fixed core 13 and the lift amount of the valve body 12 is maximum.

The IC 22 includes an injection drive circuit 22*a* which controls the switching elements SW2, SW3, SW4, and a charging circuit 22*b* which controls the booster circuit 23. These circuits 22*a* and 22*b* are operated based on an injection command signal from the microcomputer 21. The injection command signal is a signal which controls an energization condition of the coil 14. Based on the target injection quantity and the target injection start time, and a coil-current detention value "I", the microcomputer 21 generates the injection command signal. The injection command signal includes an injection signal, a boost signal and a battery signal.

The booster circuit 23 has a coil 23*a*, capacitor 23*b*, a diode 23*c*, and the switching element SW1. The charging circuit 22*b* controls the switching element SW1 in such a manner that the switching element SW1 is turned on/off repeatedly. Thus, the battery voltage supplied from the battery terminal "Batt" is boosted by the coil 23*a* to be charged in the capacitor 23*b*. The boost and charged voltage corresponds to "boost voltage".

When the injection drive circuit 22*a* turns on the switching elements SW2, SW4, the boost voltage is applied to the coil 14 of the fuel injector 10. When the switching element SW2 is turned off and the switching element SW3 is turned on, the battery voltage is applied to the coil 14. When stopping a voltage-apply to the coil 14, the switching element SW2, SW3 and SW4 are turned off. The diode 24 is for avoiding that the boost voltage is applied to the switching element SW3 when the switching element SW2 is on.

The shunt resistance 25 is for detecting an electric current flowing through the switching element SW4, that is, the electric current flowing through the coil 14 (coil current). The microcomputer 21 detects the coil-current detection value "I" based on the amount of voltage drops generated by the shunt resistance 25.

Figure 3:
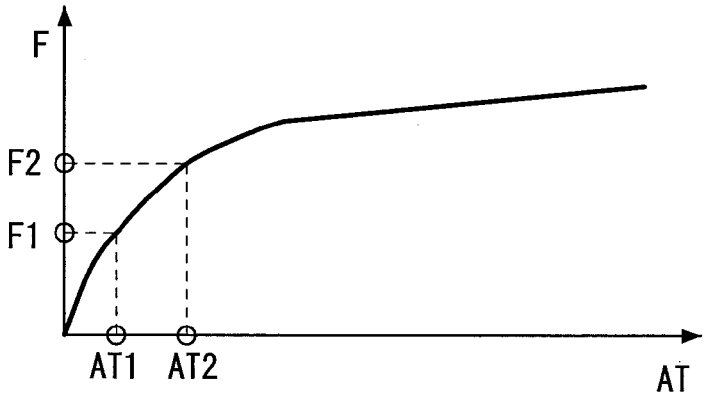
FIG. 3 is a graph showing a relationship between an ampere turn ΔT and an electromagnetic F.
Figure 4:
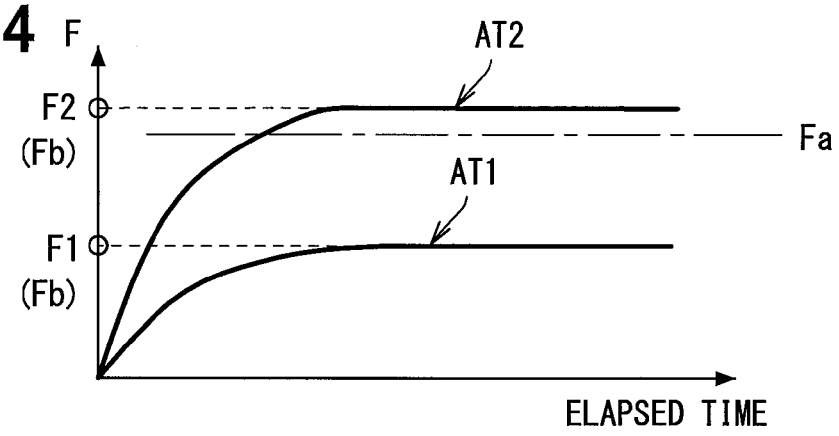
FIG. 4 is a graph showing that the electromagnetic attracting force is increased with time and is saturated to become a static attracting force.

When the coil 14 is energized, an electromagnetic attracting force F is generated as follows. As shown in FIG. 3, as a magneto-motive force (ampere turn AT) becomes larger, the electromagnetic attracting force F becomes larger. That is, in a case that the number of turns of the coil 14 is constant, as the ampere turn becomes larger (AT2>AT1), the electromagnetic attracting force F becomes larger (F2>F1). As shown in FIG. 4, a specified time period is necessary until the electromagnetic attracting force F becomes maximum. The saturated maximum electromagnetic attracting force F is referred to as a static attracting force Fb, in the present embodiment.

The electromagnetic attracting force F which is necessary to start opening the valve body 12 is referred to a required valve opening force. As the fuel pressure is higher, the required valve-opening force becomes larger. Moreover, when the viscosity of a fuel is large, the required valve-opening force becomes larger. The maximum required valve-opening force is defined as the required valve-opening force Fa.

Figures 5A, 5B, 5C, 5D:
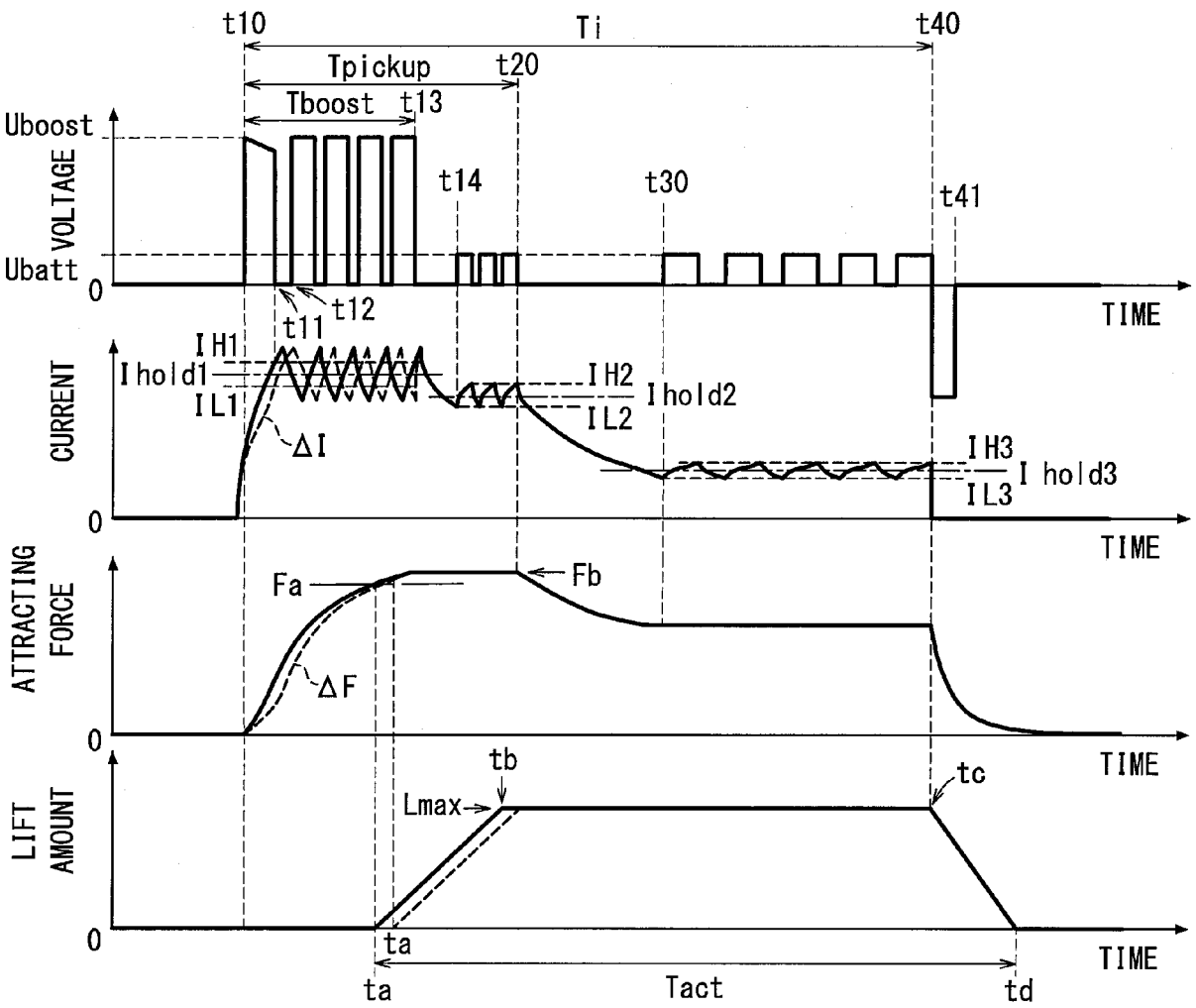
FIG. 5A is a chart showing a voltage applied to a coil.
FIG. 5B is a chart showing a coil current.
FIG. 5C is a chart showing an electromagnetic attracting force.
FIG. 5D is a chart showing a lift amount.

FIG. 5A shows a voltage waveform applied to the coil 14 when a fuel injection is conducted once. At the energization start time t10, the boost voltage is applied to the coil 14. Then, the coil current increases to a first target vale Ihold1 (refer to FIG. 5B). When the coil current reaches a first upper limit IH1 at a time t11, the coil 14 is deenergized. The first upper limit IH1 is higher than the first target value Ihold1.

By an initial boost voltage, the coil current is increased to the first target vale Ihold1 (current-increase control). A period of the current-increase control period is referred to an current-increase period t10-t11. The first target value Ihold1 is established in such a manner that the static attracting force Fb is greater than the required valve opening force Fa.

Then, when the coil current reaches at the time t12, the boost voltage is applied again. The first lower limit IL1 is lower than the first target value Ihold1. Hereafter, when coil current increases to the first upper limit IH1, the coil 14 is deenergized. When the coil current decreases to the first lower limit IL1, the coil 14 is energized.

The coil 14 is energized and deenergized repeatedly by the boost voltage, so that the average of the coil current is hold at the first target value Ihold1 by duty control (current-hold control). This current-hold control is terminated at the time t13 when an elapsed time Tboost reaches the specified time period T1. The period in which the coil 14 is energized or deenergized by the current-hold control is referred to as a current-hold period t11-t13.

Then, when the coil current reaches a second lower limit IL2, which is lower than the second target value Ihold2, at the time t14, the battery voltage is applied. Hereafter, when coil current increases to the second upper limit IH1, which is higher than the second target value Ihold2, the coil 14 is deenergized. When the coil current decreases to the second lower limit IL2, the coil 14 is energized.

The coil 14 is energized and deenergized repeatedly by the battery voltage, so that the average of the coil current is hold at the second target value Ihold2 by duty control (battery hold control). This battery hold control is terminated at the time t20 when an elapsed time Tpickup reaches the specified time period T2. The period in which the coil 14 is energized or deenergized by the battery hold control is referred to as a battery hold period t14-t20. The second target value Ihold2 is established in such a manner that the increased electromagnetic attraction force is maintained.

In FIG. 5B, the second target value Ihold2 is smaller that the first target value Ihold1. However, the second target value Ihold2 and the first target value Ihold1 may be equal to each other.

Moreover, the first upper limit IH1, the first lower limit IL1, the second upper limit IH2, and the second lower limit IL2 are established in such a manner that a variation frequency of the coil current in the current hold period is larger than that in the battery hold period.

An increasing ratio of the coil current of when the boost voltage is applied is greater that that of when the battery voltage is applied. Therefore, as shown in FIG. 5B, each values IH1, LH1, LH2, IL2 are set in such a manner that a width ΔI1 between the first upper limit IH1 and the first lower limit IL1 becomes equal to a width ΔI2 between the second upper limit IH2 and second lower limit IL2 become equal. The variation frequency in the current hold period becomes larger than the variation frequency in battery hold period. In a case that the second target value Ihold2 is equal to the first target value Ihold1, when it is set that first upper limit IH1 is equal to the second upper limit IH2 and the first lower limit IL1 is equal to the second lower limit IL2, the width ΔI1 becomes equal to the width ΔI2.

After the battery hold period t14-t20, when the coil current reaches a third lower limit IL3, which is lower than the third target value Ihold3, at the time t30, the battery voltage is applied again. Hereinafter, when coil current increases to the third upper limit IH3 which is higher than the third target value Ihold3, the coil 14 is deenergized. When the coil current decreases to the third lower limit IL3, the coil 14 is energized.

The coil 14 is energized and deenergized repeatedly by the battery voltage, the average of the coil current is held at the third target value Ihold3 by duty control (lift hold control). This lift hold control is terminated by deenergizing the coil 14 at a voltage-apply-end time t40 which is commanded by the injection command signal.

The injection signal included in an injection command signal is a pulse signal which commands the energization period Ti. A pulse-on time is set at a time t10 which is earlier that target injection start time by a period t10-ta. After an energization period Ti has passed from pulse-on time, a pulse-off time is set at a time t40. The switching element SW4 is operated according to the injection signal.

The boost signal included in the injection command signal is a pulse signal which commands the energization of the coil 14 by the boost voltage. The boost signal is turned on at the same time as the injection signal. Until the elapsed time Tboost reaches the specified time T1, a feedback control is performed so that the coil-current detection value "I" is held at the first target value Ihold1. The switching element SW2 is operated according to the boost signal.

The battery signal included in the injection command signal is turned on when the elapsed time Tboost reaches the specified time T1. Until the elapsed time Tpickup reaches the specified time T2, a feedback control is performed so that the coil-current detection value "I" is held at the second target value Ihold2. After that, until the injection signal is turned off, a feedback control is performed so that the coil-current detection value "I" is held at the third target value Ihold3. The switching element SW3 is operated according to the battery signal.

Figure 6:
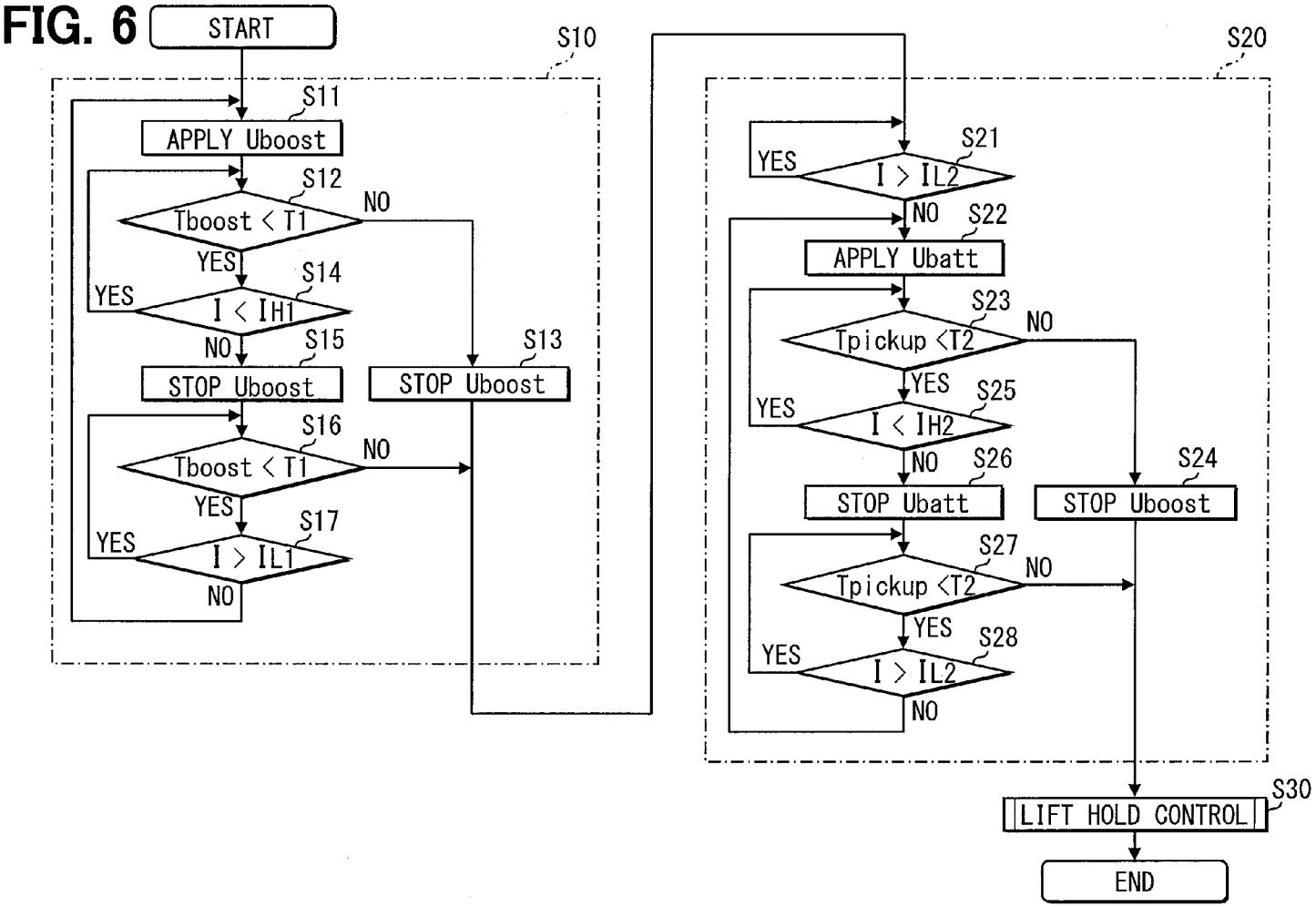
FIG. 6 is a flow chart showing a fuel injection control executed by a microcomputer of the fuel injection controller.
Figures 7A, 7B, 7C, 7D:
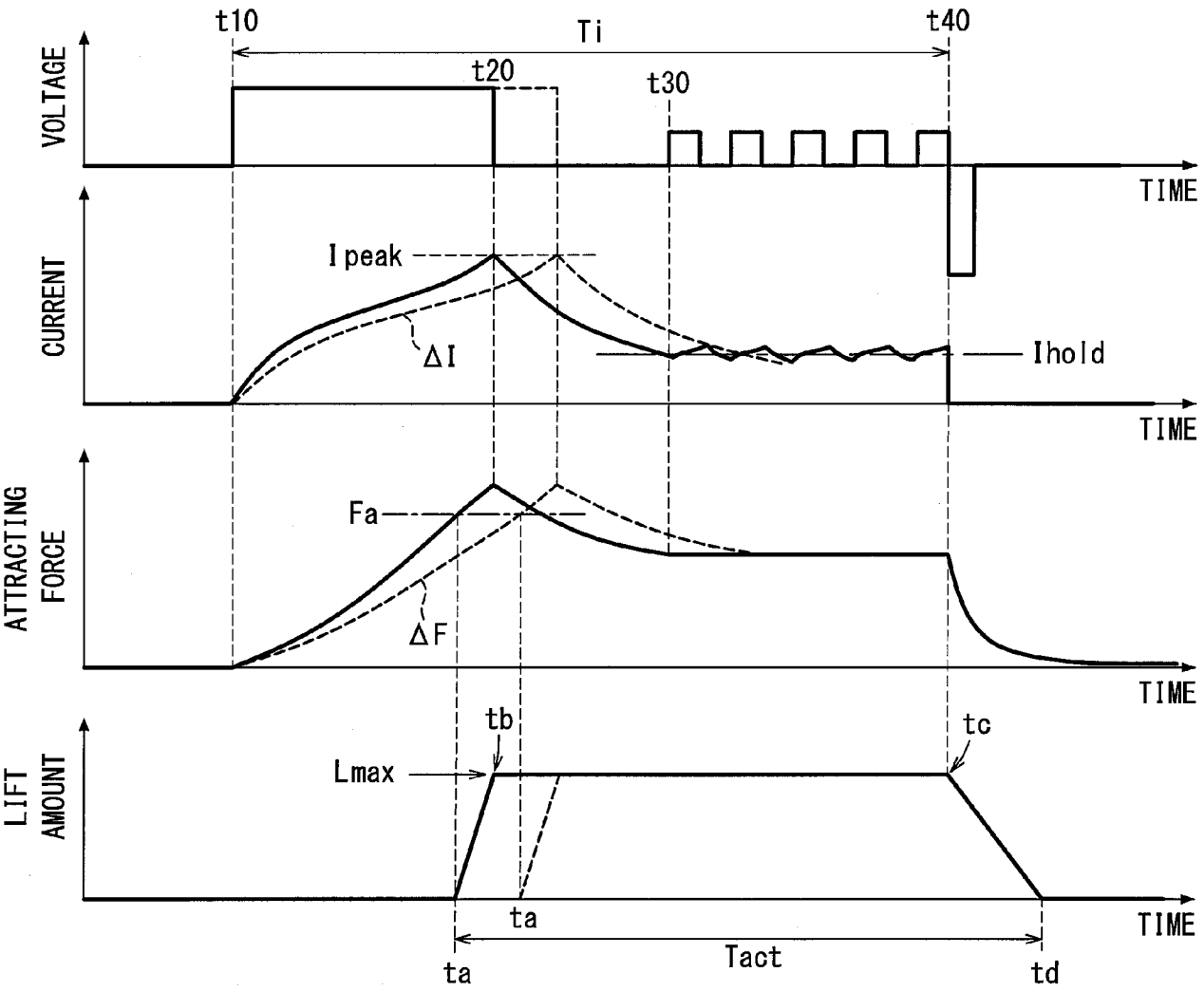
FIG. 7A PRIOR ART
FIG. 7B PRIOR ART
FIG. 7C PRIOR ART
FIG. 7D PRIOR ART
FIG. 7A is a chart showing a voltage applied to a coil in a conventional controller.
FIG. 7B is a chart showing a coil current in a conventional controller.
FIG. 7C is a chart showing an electromagnetic attracting force in a conventional controller.
FIG. 7D is a chart showing a lift amount in a conventional controller.

According to a procedure shown in FIG. 6, the microcomputer 21 outputs the boost signal and the battery signal. The procedure starts when the injection signal is generated. In step S10, the current-increase control and the current-hold control are performed. In step S20, the battery hold control is performed. In step S30, the lift hold control is performed.

In step S11, a pulse of the boost signal is turned on to start an application of the boost voltage Uboost. After that, until it is determined that the coil-current detection value "I" reaches the first upper limit IH1 (S14: NO), the pulse-on of the boost signal is continued and the application of the boost voltage Uboost is continued. The first upper limit IH1 is greater than the first target value Ihold1 by a specified value. Therefore, at a first application of the boost voltage, the coil current is increased to the first target value Ihold1, so that the current-increase control is performed.

If the elapsed time Tboost reaches the specified time T1 before the coil-current detection value "I" reaches the first upper limit IH1 (S12: NO), the pulse of the boost signal is turned off to stop the application of the boost voltage Uboost. When it is determined that the coil-current detection value "I" greater than or equal to the first upper limit IH1 in step S14, the procedure proceeds to step S15 in which the application of the boost voltage Uboost is terminated. According to the above, the current-increase control is terminated.

In step S16, it is determined whether the elapsed time Tboost is less than the specified time T1. When the answer is YES in step S16, the procedure proceeds to step S17 in which it is determined whether the coil-current detection value "I" is greater than the first lower limit IL1. Until the answer becomes No in step S17, the pulse-off of the boost signal is continued. The first lower limit IL1 is smaller than the first target value Ihold1 by a specified value.

When it is determined that the coil-current detection value "I" is greater than or equal to the first lower limit IL1 in step S17, the procedure proceeds to step S11 in which the pulse of the boost signal is turned on to start an application of the boost voltage Uboost. Therefore, until it is determined that the elapsed time Tboost greater than or equal to the specified time T1 (S12: NO, S16: NO), the boost signal is turned on/off with respect to the first upper limit IH1 and the first lower limit IL1 as thresholds. Thereby, the average of coil current is held at the first target value Ihold1, so that the current-hold control is performed.

Next, when it is determined that the elapsed time Tboost is greater than or equal to the specified time T1, the voltage-application is continued until it is determined that the coil-current detection value "I" is decreased to the second lower limit IL2. The second lower limit IL2 is smaller than the second target value Ihold2 by a specified value. In FIG. 5B, the second target value Ihold2 is smaller that the first target value Ihold1. However, the second target value Ihold2 and the first target value Ihold1 may be equal to each other.

When it is determined that the coil-current detection value "I" is less than or equal to the second lower limit IL2 in step S21, the procedure proceeds to step S22 in which the pulse of the battery signal is turned on to start an application of the battery voltage Ubatt. After that, until it is determined that the coil-current detection value "I" reaches the second upper limit IH2 (S25: NO), the pulse-on of the battery signal is continued and the application of the battery voltage Ubatt is continued. The second upper limit IH2 is greater than the second target value Ihold2 by a specified value.

When it is determined that the coil-current detection value "I" is greater than or equal to the second upper limit IH2 in step S25, the procedure proceeds to step S26 in which the pulse of the battery signal is turned off to terminate an application of the battery voltage Ubatt. When it is determined that the coil-current detection value "I" is less than or equal to the second lower limit IL2 in step S28, the procedure proceeds to step S22 in which the pulse of the battery signal is turned on to start an application of the battery voltage Ubatt. Therefore, until it is determined that the elapsed time Tpickup reaches a specified time T2 (S23: NO, S27: NO), the battery signal is turned on/off with respect to the second upper limit IH2 and the second lower limit IL2 as thresholds. Thereby, the average of coil current is held at the second target value Ihold2, so that the battery hold control is performed.

Next, when it is determined that the elapsed time Tpickup greater than or equal to the specified time T2 (S23: NO, S27: NO), the pulse of the battery signal is turned off in steps S24 and S26 and the procedure proceeds to step S30. In step S30, the battery signal is turned on/off with respect to the third upper limit IH3 and the third lower limit IL3 as thresholds. Thereby, the average of coil current is held at the third target value Ihold3, so that the lift hold control is performed.

The third upper limit IH3 is greater than the third target value Ihold3 by a specified value. The third lower limit IL3 is smaller than the third target value Ihold3 by a specified value. The third target value Ihold3 is smaller than the second target value Ihold2 by a specified value.

Referring to FIGS. 5C and 5D, an operation of the fuel injector 10 will be explained. FIG. 5C shows the electromagnetic attracting force F, and FIG. 5D shows a variation of the lift amount.

As shown in FIG. 5C, the electromagnetic attracting force F starts to increase when the current-increase control is started. Even after the current-increase control is terminated, the electromagnetic attracting force F continues to increase. During the current-hold period t11-t13, the electromagnetic attracting force F reaches the required valve-opening force Fa. When the electromagnetic force F becomes the required valve-opening force Fa at the time "ta", the seat surface 12*a* of the valve body 12 moves away from the body seat surface 11*b* and valve-opening operation is started (refer to FIG. 5D).

Then, when the coil current is held at first target value Ihold1 by the hold control, the electromagnetic force F is increased to the static attracting force Fb. That is, the specified time T1 of the elapsed time Tboost is established in such a manner that the electromagnetic attracting force F becomes the static attracting force Fb during the current-hold period t11-t13. Since the first target value Ihold1 is established in such a manner that the static attracting force Fb is greater than the required valve opening force Fa, the electromagnetic attracting force F reaches the required valve-opening force Fa in a period in which the electromagnetic attracting force F becomes the static attracting force Fb.

After the boost voltage is changed to the battery voltage at the time t14, the coil current is held at the second target value Ihold2 by the battery hold control. The second target value Ihold2 is established in such a manner that the static attracting force Fb is maintained. Therefore, during the battery hold period t14-t20, the electromagnetic attracting force F is held at the static attracting force Fb. The specified time T2 of the elapsed time Tpickup is established in such a manner that the lift amount becomes the maximum value Lmax during the battery hold period t14-t20.

Then, the electromagnetic attracting force F is decreased to a specified value in a period between the time t20 and the time t30. In a period between the time t20 and the time t40, the lift position is maintained at the maximum value Lmax.

Then, after the lift hold control is terminated, the valve body 12 starts to close and the lift amount is decreased. When the lift amount becomes zero at the time td, the seat surface 12*a* of the valve body 12 sits on the body seat surface 11*b*. During a period between the time t40 and the time t41, a reverse phase voltage is applied to the coil 14, whereby a falling of electric current is made earlier and a valve-close responsiveness of the valve body 12 is improved.

According to the present embodiment, in the current-increase period t10-t11 and the hold period t11-t13, the electromagnetic attracting force is increased to the static attracting force Fb. Therefore, the rate of the increase period t10-t11 relative to the attractive force increase period t10-ta is made smaller. Therefore, the increasing ratio ΔF of attracting force hardly receive the influence of the temperature characteristic (FIG. 5C). It is restricted that the valve opening time "ta" and the valve opening period Tact are varied according to the temperature characteristic (FIG. 5D). Therefore, it is restricted that the fuel injection accuracy is deteriorated relative to the energization period Ti and the energization start time t1. The robustness of the control relative to the temperature characteristic can be improved.

Furthermore, according to the present embodiment, by performing the current-hold control after the increase control, the electromagnetic attracting force is increased to the static attracting force Fb. Thus, the maximum value of the coil current can be smaller that the conventional control in which the electromagnetic attracting force is increased more than the required valve-opening force Fa without performing the current-hold control. Therefore, the energy for fuel injection can be reduced.

Furthermore, according to the present embodiment, following advantages can be also obtained.

In the current-increase control and the current-hold control, the voltage-application to the coil 14 is controlled in such a manner that the valve opening is not started while the coil current is held at the first target value. In other words, the voltage and the voltage applying time in the increase control are controlled, so that the valve opening is not started during the increase control. The duty ratio of the current-hold control and the current-hold control time are controlled, so that the valve opening is started during the current-hold control.

Therefore, it can be avoided that the valve opening is started during the current-increase control. The rate of the current-increase period t10-t11 relative to the attractive force increase period t10-ta is made smaller.

In the current-increase control and the current-hold control, the boost voltage is applied to the coil 14 to perform the current-hold control. Then, the battery voltage is applied to the coil 14 so that the coil current is held at the second target value Ihold2 to perform the battery hold control. The second target value Ihold2 is established in such a manner that the increased electromagnetic attraction force (static attracting force Fb) is maintained.

If a performing period of the current-hold control is made longer than needed, a period in which the boost voltage is used is made longer. Thus, it is likely that the energy consumption for one injection may be increased. That is, the capacity of the capacitor 23*b* is necessary to be increased.

According to the present embodiment, after the current-hold control is performed, the control is switched into the battery hold control. That is, after the coil current reaches the second target value Ihold2, the battery voltage can keep the second target value Ihold2. In view of this, the boost voltage is switched to the battery voltage and the coil current is held at the second target value Ihold2 so that the static attracting force Fb is maintained. Therefore, according to the present embodiment, it is restricted that the energy consumption is increased. The capacity of the capacitor 23*b* can be made small.

The first upper limit IH1, the first lower limit IL1, the second upper limit IH2 and the second lower limit IL2 are established in such a manner that the variation frequency (first frequency) of the coil current in hold period is larger than the variation frequency (second frequency) of the coil current in battery hold period.

If the first frequency is equal to the second frequency, the range of fluctuation of the coil current in hold time will become large, so that the energy efficiency is deteriorated. According to the present embodiment, since each value IH1, IL1, IH2 and IL2 are established, the range of fluctuation of the coil current in current-hold time can be made small. The energy efficiency is not deteriorated.

[Other Embodiment]

The present invention is not limited to the embodiments described above, but may be performed, for example, in the following manner. Further, the characteristic configuration of each embodiment can be combined.

In the above embodiments, after the current-hold control is performed, the battery hold control is performed. The static attracting force Fb is maintained by the battery hold control. However, the battery hold control is not always necessary. Even after the attracting force reached the static attracting force Fb, the boosted voltage application by the current-hold control is continued to maintain the static attracting force Fb.

In the above embodiments, the second target value Ihold2 is smaller that the first target value Ihold1. However, the second target value Ihold2 and the first target value Ihold1 may be equal to each other.

The difference between the first upper limit IH1 and the first lower limit may be different from the difference between the second upper limit IH2 and the second lower limit IL2.

In the above embodiments, the controller controls the fuel injector 10 mounted to a gasoline engine. However, the controller controls the fuel injector mounted to a diesel engine. The fuel injector can inject the fuel into an intake pipe.

What is claimed is:

1. A fuel injection controller applied to a fuel injector which opens a valve body by electromagnetic attracting force generated by applying a coil current to a coil, the fuel injection controller comprising:

a current-increase control portion applying a voltage to the coil so that the coil current is increased to a first target value;

a current-hold control portion applying the voltage to the coil so that the increased coil current is held at the first target value;

a battery hold control portion performs a battery hold control in which the coil current is held at a second target value lower than the first target value after a control by the current-hold control portion, and a booster circuit which boosts a battery voltage; wherein:

in a case that a maximum electromagnetic attracting force to start a valve opening is referred to as a required valve-opening force, and a saturated electromagnetic attracting force by the coil current of the first target value is referred to as a static attracting force, the first target value is established in such a manner that the static attracting force is greater than or equal to the required valve opening force, the current-increase control portion and the current-hold control portion control a voltage application to the coil so that the valve body starts opening while the coil current is held at the first target value, the current-increase control portion and the current-hold control portion apply a boost voltage to the coil, and the battery hold control portion starts performing the battery hold control before a lift amount of the valve becomes a maximum value.

2. A fuel injection controller according to claim 1, wherein when the coil current reaches a first upper limit, which is higher than the first target value, the current-hold control portion deenergizes the coil, and when the coil current reaches a first lower limit, which is lower than the first target value, the current-hold control portion energizes the coil, thereby an average of the coil current becomes the first target value, when the coil current reaches a second upper limit, which is higher than the second target value, the battery hold control portion deenergizes the coil, and when the coil current reaches a second lower limit, which is lower than the second target value, the battery hold control portion energizes the coil, thereby an average of the coil current becomes the second target value, and the first upper value, the first lower value, the second upper value and the second lower value are established in such a manner that a variation frequency of the coil current during the current-hold control is greater than the variation frequency of the coil current during the battery hold control.

3. A fuel injection system comprising:

a fuel injection controller according to claim 1, and a fuel injector injecting a fuel into an internal combustion engine.

* * * * *